US007204096B2

(12) United States Patent
Iwata et al.

(10) Patent No.: US 7,204,096 B2
(45) Date of Patent: Apr. 17, 2007

(54) INDOOR APPARATUS FOR AIR CONDITIONER

(75) Inventors: Toru Iwata, Osaka (JP); Masakazu Hirai, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 198 days.

(21) Appl. No.: 10/533,200

(22) PCT Filed: Oct. 30, 2003

(86) PCT No.: PCT/JP03/13961

§ 371 (c)(1),
(2), (4) Date: Apr. 28, 2005

(87) PCT Pub. No.: WO2004/040204

PCT Pub. Date: May 13, 2004

(65) Prior Publication Data

US 2006/0010901 A1 Jan. 19, 2006

(30) Foreign Application Priority Data

Oct. 31, 2002 (JP) ..... 2002-317696

(51) Int. Cl.
*F25D 17/06* (2006.01)

(52) U.S. Cl. ..... 62/426; 454/292

(58) Field of Classification Search ..... 62/186, 62/259.1, 407, 408, 419, 426; 454/292, 299
See application file for complete search history.

(56) References Cited

U.S. PATENT DOCUMENTS

| | | | | |
|---|---|---|---|---|
| 2,053,395 | A * | 9/1936 | Dodge | 454/99 |
| 3,766,750 | A * | 10/1973 | Aoh et al. | 62/259.1 |
| 5,001,968 | A * | 3/1991 | Sodec et al. | 454/302 |
| 5,003,867 | A * | 4/1991 | Sodec et al. | 454/236 |
| 6,010,402 | A * | 1/2000 | Schmidt | 454/300 |
| 6,264,552 | B1 * | 7/2001 | Oya et al. | 454/304 |
| 6,302,780 | B1 * | 10/2001 | Ahn et al. | 454/136 |
| 6,357,249 | B1 * | 3/2002 | Robinson et al. | 62/285 |

FOREIGN PATENT DOCUMENTS

| | | |
|---|---|---|
| JP | 61-259050 A | 11/1986 |
| JP | 62-124414 A | 8/1987 |
| JP | 62-171726 U | 10/1987 |
| JP | 1-178526 U | 12/1989 |
| JP | 02-008648 A | 1/1990 |

(Continued)

*Primary Examiner*—Mohammad M. Ali
(74) *Attorney, Agent, or Firm*—Birch, Stewart, Kolasch & Birch, LLP

(57) ABSTRACT

An air discharge outlet comprises line air discharge outlets (35) and corner air discharge outlets (36). The line air discharge outlets (35) are so formed as to extend, respectively, along four sides of a casing bottom part having four side parts and four corner parts wherein the side and corner parts are formed in contiguous relationship to one another. The corner air discharge outlets (36) are formed, respectively, in the four casing corner parts so that each corner air discharge outlet (36) establishes connection between adjacent ones of the line air discharge outlets (35). And, each line air discharge outlet (35) is provided with a swing vane (38) swingable about a longitudinal shaft (41) of each line air discharge outlet (35). Each corner air discharge outlet (36) is provided with a fixed stationary vane (39).

5 Claims, 7 Drawing Sheets

FOREIGN PATENT DOCUMENTS

| | | | | |
|---|---|---|---|---|
| JP | P 2000-46366 | A | * | 2/2000 |
| JP | 2000-154933 | A | | 6/2000 |
| JP | 2000-205642 | A | | 7/2000 |
| JP | 2000-220878 | A | | 8/2000 |
| JP | 2000-249393 | A | | 9/2000 |
| JP | P 2001-116349 | A | * | 4/2001 |
| JP | 2001-133019 | A | | 5/2001 |
| JP | 2001-133032 | A | | 5/2001 |
| JP | P 2001-173983 | A | * | 6/2001 |
| JP | 2001-201165 | A | | 7/2001 |
| JP | 2001-336783 | A | | 12/2001 |

* cited by examiner

INDOOR APPARATUS FOR AIR CONDITIONER

TECHNICAL FIELD

The present invention relates to indoor units for air conditioning apparatuses and particularly concerns improvements in air discharge outlet structures.

BACKGROUND ART

A conventional air conditioning apparatus indoor unit adapted for ceiling mounting typically includes a casing for housing a fan and a heat exchanger, a square-shaped air suction inlet formed centrally in the underpart of the casing and straight groove-like air discharge outlets formed so as to extend, around the air suction inlet, along four sides of the air suction inlet, respectively. In the indoor unit, indoor air drawn in through the air suction inlet when the fan is driven is heated or cooled to generate conditioned air, and the conditioned air is discharged in four directions through the air discharge outlets, respectively.

Generally, such an air discharge outlet is provided with a flap (vane) capable of vertical adjustment with respect to the flow direction of air discharged therefrom. The flap is mounted such that it can be swung about a longitudinal axis of the air suction inlet.

And now, in order to air-condition a room to a preset temperature, it is required that conditioned air be discharged into the room at a predetermined flow rate. In general, it is common to increase the flow rate of air which is discharged from the air discharge outlet by increasing the velocity thereof. This however creates unpleasant draft-feeling problems to the user when the velocity at which the conditioned air is discharged is increased.

With a view to coping with such problems, Japanese Patent Application Kokai Publication No. 2001-201165 discloses a technique. More specifically, in this prior art technique, an air discharge outlet shaped like a ring groove is defined around an air suction inlet so that air is discharged radially outwardly in all directions over the entire periphery of the air discharge outlet. As just described, the air discharge outlet is shaped like a ring groove to be increased in length as a whole. As a result of such arrangement, the area of the air discharge outlet is greatened, thereby making it possible to increase the flow rate of air to be discharged while making the velocity of the air as low as possible.

In the conventional indoor unit, the air discharge outlet is shaped like a circular arc. Accordingly, the flap is not allowed to swing up and down in the air discharge outlet. Therefore, the conventional indoor unit is equipped with a slide mechanism by which the flap can be shifted vertically in sliding manner.

The slide mechanism is made up of a swing link formed integrally with the flap, a lever one end of which is pin-coupled to the swing link and the other end of which is coupled to the drive shaft of a motor, a spring establishing connection between the lever and the casing, a swing shaft formed integrally with the flap and a guide groove for providing vertical guidance of the swing shaft. And, the swing shaft is guided vertically along the guide groove by the driving of the motor or by the elasticity of the spring, thereby causing the flap to move up and down. In this way, the adjustment in the flow direction of air discharged from the air discharge outlet is made.

Problem to be Solve

The above-described conventional indoor unit, however, requires the provision of a slide mechanism for moving a flap up and down. This makes structures for adjusting the flow direction of air discharged from the air discharge outlet complicated, thereby giving rise to a problem of high costs.

Bearing in mind the above-described problem with the prior art technique, the present invention was made. Accordingly, an object of the present invention is to decrease user's discomfort caused by a draft (hereinafter "draft feeling") by improvements in the structure of air discharge outlets in an air conditioning apparatus indoor unit, and another object of the present invention is to reduce costs by providing simplified structures for adjusting the flow direction of air discharged from the air discharge outlet.

DISCLOSURE OF INVENTION

In order to achieve the above-described objects, in the present invention, line air discharge outlets extending, respectively, along four sides of a casing bottom portion and corner air discharge outlets each establishing connection between adjacent ones of the line air discharge outlets at a casing corner are provided. The flow direction of air discharged from the corner air discharge outlets is fixed while on the other hand the flow direction of air discharged from the line air discharge outlets is adjustable.

More specifically, a first invention is directed to an indoor unit for an air conditioning apparatus, adapted for room-ceiling mounting, which is provided with an air discharge outlet (16) for discharge of conditioned air therefrom. And, the air discharge outlet (16) comprises (a) line air discharge outlets (35) extending, respectively, along four sides of a casing bottom part (11) having four side parts (11*a*) and four corner parts (11*b*) wherein the parts (11*a*, 11*b*) are formed in contiguous relationship to one another and (b) corner air discharge outlets (36) formed, respectively, in the four corner parts (11*b*), each corner air discharge outlet (36) establishing connection between adjacent ones of the line air discharge outlets (35). Each line air discharge outlet (35) is provided with a swing vane (38) swingable about a longitudinal shaft (41) of each line air discharge outlet (35). And, each corner air discharge outlet (36) is provided with a guide means (39) by means of which conditioned air is discharged in a fixed direction.

In the above-described invention, conditioned air is discharged from the line air discharge outlets (35) as well as from the corner air discharge outlets (36). Stated another way, the total opening area of the air discharge outlet (16) is greater than that of an indoor unit of the type which has only the line air discharge outlets (35). As a result, when supplying air into the inside of a room at a predetermined flow rate, the velocity at which the air is discharged becomes relatively low. This decreases user's draft feeling.

In addition, at the corner air discharge outlet (36), air is discharged in a predetermined direction by the guide means (39). On the other hand, at the line air discharge outlet (35), the flow direction of air discharged therefrom is adjusted by the swing vane (38), thereby performing air condition operation in such an adequate way as to maintain the temperature distribution as uniform as possible.

In a second invention according to the first invention, the guide means (39) is a fixed stationary vane (39).

In the above-mentioned invention, air is blown out in a predetermined fixed direction by the stationary vane (39).

In a third invention according to the first invention, each swing vane (38) is so configured as to be individually able to be held in a predetermined tilting position.

When air is discharged against a room wall or window, the discharged air undergoes turbulence and a draft tends to take place. On the contrary, in the second invention, in the case where the indoor unit is installed in a ceiling area near to a window or the like, the swing vane (38) on the wall side is individually swung downwardly and is held in such a tilting position. As a result, at the line air discharge outlet (35) on the wall side, air is discharged downwardly, therefore decreasing drafts. Besides, air conditioning operation is adequately performed on the perimeter of the room by the air supplied downwardly from the line air discharge outlet (35) located on the wall side.

In a fourth invention according to the third invention, motors (43) for respectively driving the swing vanes (38) are connected, respectively, to shafts (41) of the swing vanes (38), and a controller (45) for controlling the driving of the motors (43) is connected, via switches (46) each operable to establish connection and disconnection between its associated motor (43) and the controller (45), to the motors (43).

In the above-mentioned invention, the driving of each motor (43) is controlled by the controller (45). Being individually driven by its associated motor (43), each swing vane (38) is caused to swing. When the indoor unit is installed near to a room wall or the like, the motor (43) connected to the swing vane (38) on the wall side is disconnected from the controller (45) by the switch (46). Thereafter, the swing vane (38) on the wall side is swung downwardly and is held in such a downwardly swung position.

In a fifth invention according to the third invention, motors (43), connected, respectively, to shafts (41) of the swing vanes (38), for respectively driving the swing vanes (38), and switches each operable to interrupt the drive current of its associated motor (43) are provided.

In the above-mentioned invention, in the case where the indoor unit is installed near to a room wall or the like, the drive current of the motor (43) connected to the swing vane (38) on the wall side is interrupted by the associated switch. Thereafter, the swing vane (38) on the wall side is swung downwardly and is held in such a downwardly swung position.

Effects of Invention

In the first invention, an air discharge outlet (16) comprises line air discharge outlets (35) extending, respectively, along four sides of a casing bottom part (11) having four side parts (11*a*) and four corner parts (11*b*) wherein these side and corner parts (11*a*) and (11*b*) are formed in contiguous relationship to one another, and corner air discharge outlets (36) formed, respectively, in the four corner parts (11*b*), each corner air discharge outlet (36) establishing connection between adjacent ones of the line air discharge outlets (35); each line air discharge outlet (35) is provided with a swing vane (38) swingable about a longitudinal axis of each line air discharge outlet (35); and each corner air discharge outlet (36) is provided with a guide means (39) by means of which conditioned air is discharged in a fixed direction.

In accordance with the first invention, conditioned air is discharged from the line air discharge outlets (35) as well as from the corner air discharge outlets (36), thereby making it possible to increase the total opening area of the air discharge outlet (16). As a result, when supplying conditioned air into the inside of a room at a predetermined flow rate, the velocity at which the conditioned air is discharged becomes relatively low. This decreases user's draft feeling.

In addition, at the corner air discharge outlet (36), conditioned air is discharged in a predetermined direction by means of a simplified structure, i.e. the guide means (39).

Furthermore, at the line air discharge outlet (35), the flow direction of conditioned air discharged therefrom is adjusted by the swing vane (38), thereby performing adequate air conditioning operation capable of providing a uniform temperature distribution on the room.

In addition, it is arranged such that the flow direction of conditioned air discharged from the line air discharge outlet (35) is adjusted by causing the swing vane (38) extending in a straight line to swing. As a result of such arrangement, it becomes possible to reduce costs by such a simplified structure.

In the second invention, the guide means (39) is formed by a fixed stationary vane (39).

In accordance with the second invention, it is possible to discharge conditioned air in a predetermined fixed direction by means of a simplified structure, i.e. the stationary vane (39).

In the third invention, each of the swing vanes (38) is so configured as to be individually able to be held in a predetermined tilting position.

In accordance with the third invention, it becomes possible, when the indoor unit is installed at a ceiling area near to a room wall or the like, to allow the swing vane (38) on the wall side to individually swing downwardly and to be held in such a downwardly swung position. As a result, conditioned air is blown out downwardly from the line air discharge outlet (35) on the wall side. Therefore, conditioned air is prevented from being discharged against the wall, thereby making it possible to decrease drafts.

Furthermore, it is possible to adequately perform air conditioning operation on the perimeter of the room by the use of air supplied downwardly from the line air discharge outlet (35) on the wall side.

In the fourth invention, motors (43) for respectively driving the swing vanes (38) are connected, respectively, to shafts (41) of the swing vanes (38), and a controller (45) for controlling the driving of the motors (43) is connected, via switches (46) each operable to establish connection and disconnection between its associated motor (43) and the controller (45), to the motors (43).

In accordance with the fourth invention, in the case where the indoor unit is installed near to a room wall or the like, it is possible to establish disconnection between the motor (43) connected to the swing vane (38) on the wall side and the controller (45) by means of the associated switch (46).

In the fifth invention, motors (43), connected, respectively, to shafts (41) of the swing vanes (38), for respectively driving the swing vanes (38), and switches each operable to interrupt the drive current of its associated motor (43) are provided.

In accordance with the fifth invention, in the case where the indoor unit is installed near to a wall or the like, the drive current of the motor (43) connected to the swing vane (38) on the wall side can be interrupted by the associated switch. As a result, it becomes possible for the wall-side swing vane (38) to be swung downwardly and held in such a downwardly swung position.

BEST MODE FOR CARRYING OUT INVENTION

Hereinafter, embodiments of the present invention will be described with reference to the drawings.

Embodiment 1

Figure 1:
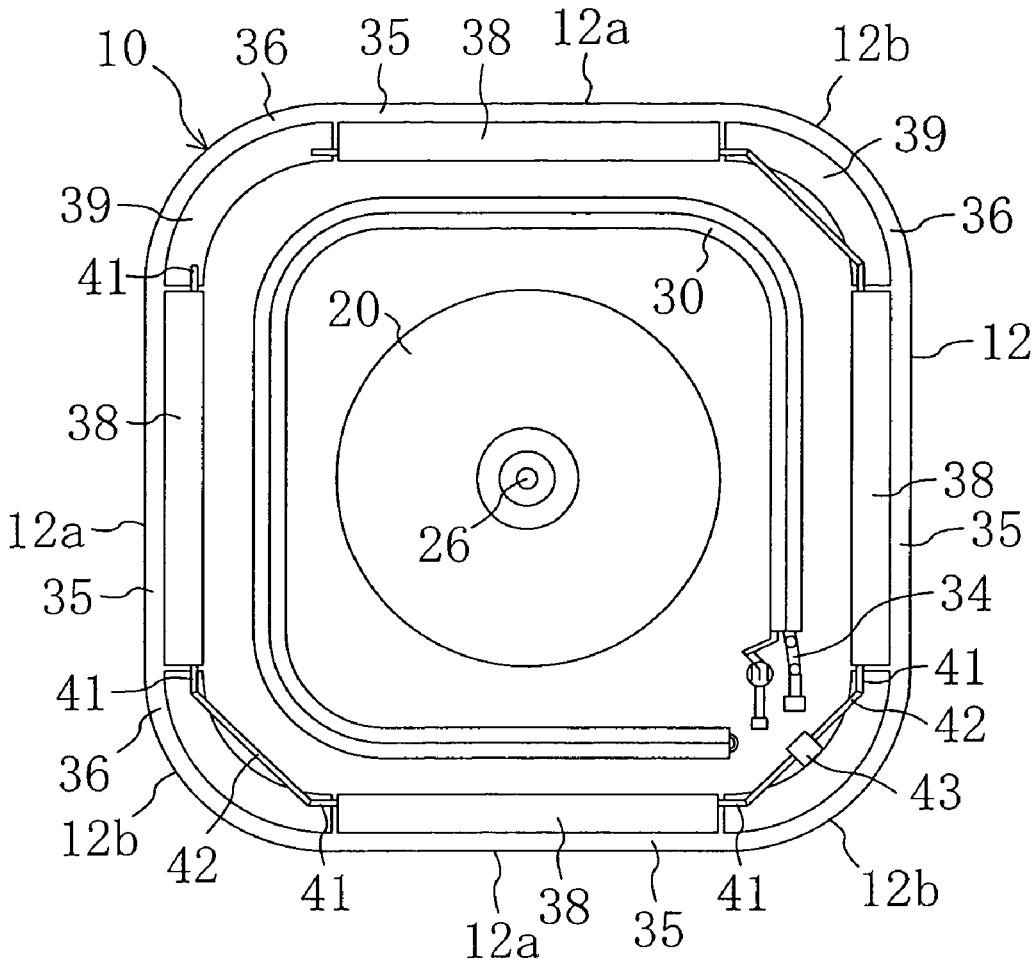
FIG. 1 is a front view schematically illustrating the interior of a casing of an indoor unit according to a first embodiment of the present invention.
Figure 2:
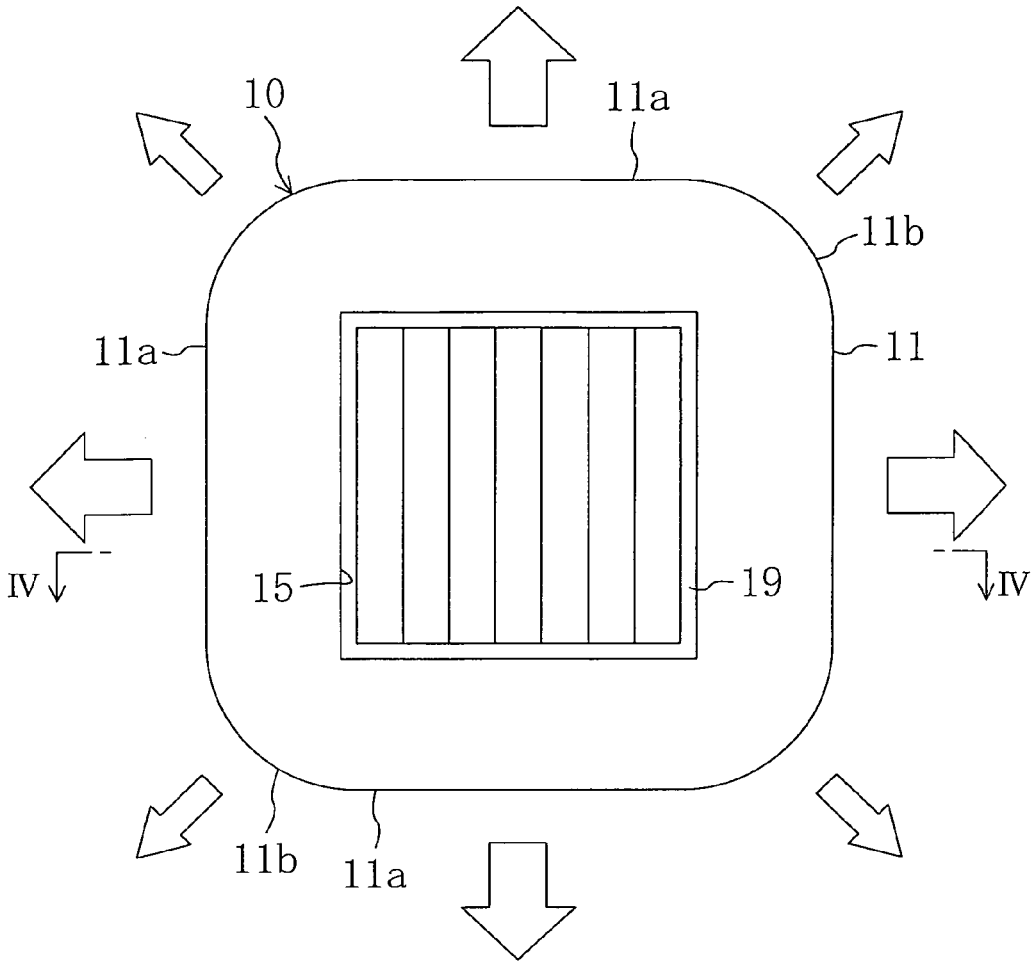
FIG. 2 is a front view illustrating an external outline of the indoor unit of the first embodiment.
Figure 3:
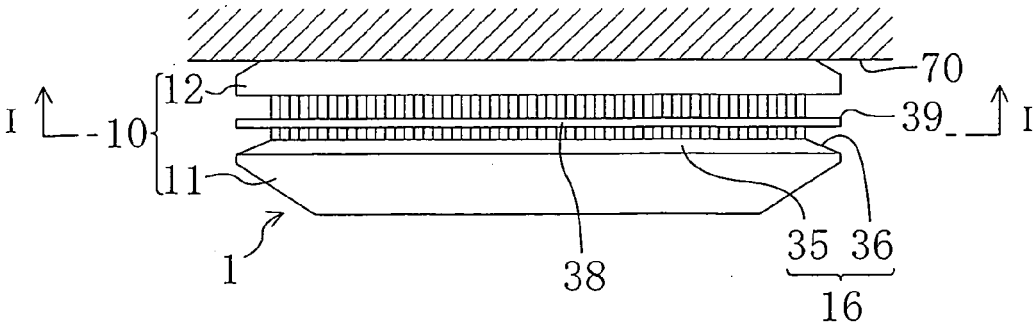
FIG. 3 is a side view schematically illustrating the indoor unit of the first embodiment.
Figure 4:
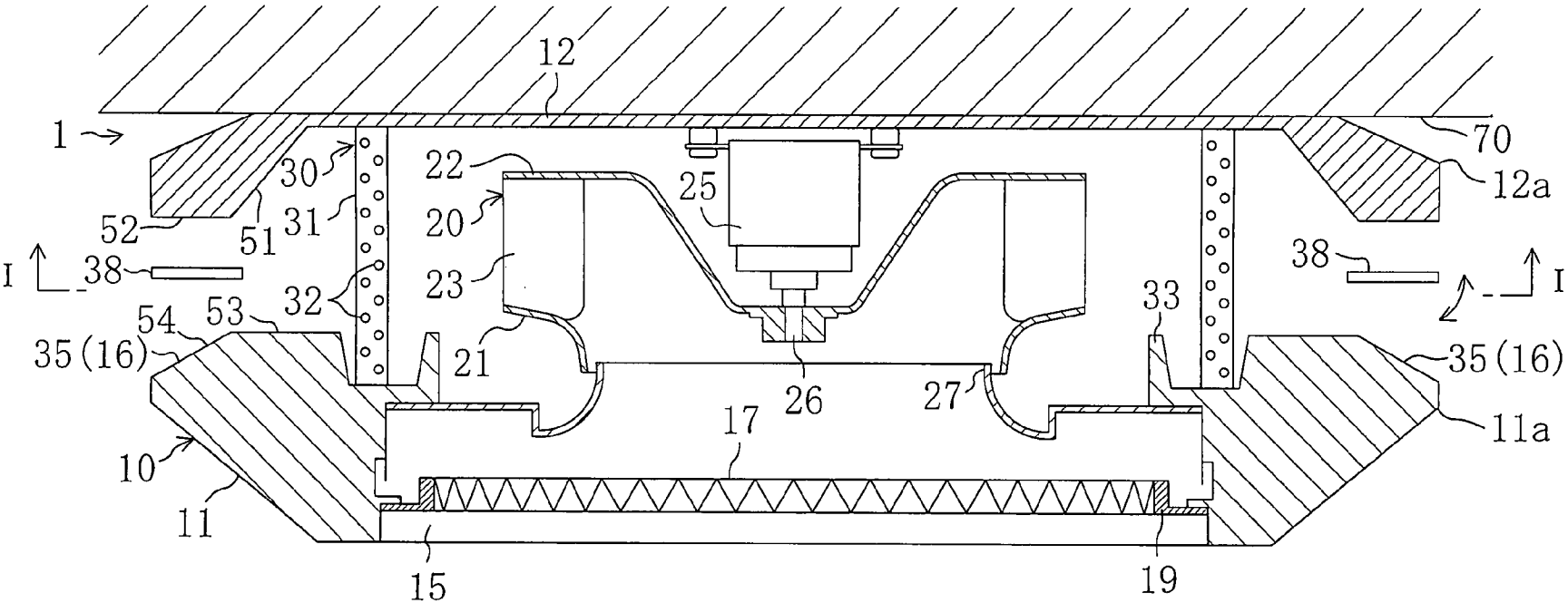
FIG. 4 is a cross sectional view taken along line IV—IV of FIG. 2.

Referring first to FIGS. 1–4, there is shown a first embodiment of an air conditioning apparatus indoor unit according to the present invention. FIG. 1 is an illustration when viewed from line I—I of FIGS. 3 and 4. As shown in FIG. 4, the indoor unit (1) is an indoor unit of the type which is hung from the ceiling. Enclosed in a casing (10) are a fan (20) and a heat exchanger (30). The indoor unit (1) is mounted onto a room ceiling surface (70).

The casing (10), as shown in FIGS. 3 and 4, is made up of a top plate (12) as a casing top part which is firmly affixed to the ceiling surface (70) and a bottom plate (11) as a casing bottom part which is connected to the top plate (12) such that it faces the top plate (12) from below. The top plate (12) and the bottom plate (11) are formed into a substantially square shape and have four corner parts shaped like a circular arc. In other words, as shown in FIG. 1, the top plate (12) includes four side parts (12*a*, 12*a*, 12*a*, 12*a*) and four corner parts (12*b*, 12*b*, 12*b*, 12*b*) which are formed in contiguous relationship to one another. Likewise, as shown in FIG. 2, the bottom plate (11) includes four side parts (11*a*, 11*a*, 11*a*, 11*a*) and four corner parts (11*b*, 11*b*, 11*b*, 11*b*) which are formed in contiguous relationship to one another.

Centrally formed in the bottom plate (11) is an air suction inlet (15) with a square opening, as shown in FIG. 2. The air suction inlet (15) is provided, all over the surface thereof, with an air filter (17) for removing suspended solids such as dust contained in the indoor air. The air filter (17) is firmly supported by a lattice-shaped filter cover (19).

The fan (20), as shown in FIG. 4, is a so-called turbo fan made up of a shroud (21), a hub (22) and a blade (23) which is held between the shroud (21) and the hub (22). The fan (20) is disposed substantially centrally in the inside of the casing (10). The fan (20) is attached, via a fan motor (25), to the casing (10).

The fan motor (25) is firmly fastened to the center of the top plate (12) by a bolt or other fastening means. The fan motor (25) has a drive shaft (26) which extends downwardly and which is coupled to the hub (22) of the fan (20). In addition, disposed below the fan (20) is a bell-mouth (27) for guiding inflowing air into the casing (10) from the air suction inlet (15), to below the fan (20). And, the fan (20) is rotationally driven by drive force of the fan motor (25), whereby air drawn in from below through the bell-mouth (27) is sent out outwardly relative to the radial direction of the fan (20).

The heat exchanger (30) is a so-called cross fin heat exchanger which is made up of a large number of plate-like fins (31) arranged in parallel with each other and heat transfer tubes (32) disposed so as to pass through the fins (31). The heat exchanger (30) is shaped like a tube which is rectangular in plan view and is disposed so as to enclose the periphery of the fan (20). The heat exchanger (30) is supported by being vertically sandwiched between the top plate (12) and the bottom plate (11).

The heat exchanger (30) is connected, via a refrigerant line (34), to an outdoor unit (not shown). The heat exchanger (30) serves as an evaporator during cooling mode of operation and as a condenser during heating mode of operation, and generates conditioned air by cooling or heating air supplied by the fan (20). In addition, a drain pan (33) for receiving drain water is disposed below the heat exchanger (30). The drain pan (33) is formed on top of the bottom plate (11).

An air discharge outlet (16) for blowing out conditioned air is so formed as to continuously extend in the circumferential direction of the side part of the casing (10). In other words, as shown in FIG. 4, there is defined a predetermined gap between the peripheral edge of the top plate (12) and the peripheral edge of the bottom plate (11). This gap serves as the air discharge outlet (16).

The air discharge outlet (16) is made up of line air discharge outlets (35) and corner air discharge outlets (36). With reference to FIGS. 2 and 3, the line air discharge outlets (35) are formed, respectively, in side surfaces of the casing (10) so that they extend, respectively, along the four side parts (11*a*, 11*a*, 11*a*, 11*a*) of the bottom plate (11). On the other hand, the corner air discharge outlets (36) are formed, respectively, at the four corner parts (11*b*, 11*b*, 11*b*, 11*b*) of the casing (10) wherein each corner air discharge outlet (36) is configured so as to establish connection between one line air discharge outlet (35) and the adjacent line air discharge outlet (35). And, the line air discharge outlets (35) and the corner air discharge outlets (36) are formed in contiguous relationship to one another.

Formed in a peripheral edge area of the top plate (12) are a guide surface (51) extending obliquely down to the outside from the internal portion where the heat exchanger (30) is disposed and a horizontal surface (52) extending continuously to the outside from the guide surface (51). On the other hand, formed in the bottom plate (11) are a horizontal surface (53) extending outwardly from the outer edge of the drain pan (33) and a guide surface (54) extending continuously obliquely down to the outside from the horizontal surface (54).

On the inside of the line and corner air discharge outlets (35) and (36), there is defined an air passageway formed by the guide and horizontal surfaces (51) and (52) of the top plate (12) and the horizontal and guide (53) and (54) of the bottom plate (11). A flow of air supplied by the fan (20) is throttled by the guide and horizontal surfaces (51) and (53) after which the air is guided to the outside by the horizontal and guide surfaces (52) and (54) and is discharged outside the casing (10) through each air discharge outlet (35, 36).

As shown in FIG. 1, the line air discharge outlet (35) is provided with a swing vane (38). On the other hand, the corner air discharge outlet (36) is provided with a stationary vane (39). Referring still to FIG. 1, the swing vane (38) is shaped like a substantially rectangular plate extending along the line air discharge outlet (35). A coupling pin (41) is formed at each end of the swing vane (38), extending outwardly in the longitudinal direction of the swing vane (38). Each coupling pin (41) is rotatably supported against the casing (10) and the swing vane (38) is configured to be swingable about the longitudinal axial of the line air discharge outlet (35).

At each of three of the four corner parts (12*b*, 12*b*) of the casing (10), the coupling pins (41) adjacent to each other are connected together by a coupling shaft (42). And, as the coupling shaft (42) rotates, the coupling pins (41) rotate. One of the three coupling shafts (42) that is centrally positioned is connected to the drive shaft of a motor (43). It is arranged such that when the motor (43) is driven the four swing vanes (38) are caused to swing up and down in a synchronized manner via the respective coupling shafts (42) and coupling pins (41). By the swinging of the swing vanes (38), the flow direction of air discharged from the line air discharge outlets (35) is vertically adjusted.

The stationary vane (39) constitutes a guide means by which conditioned air is discharged in a fixed direction and is shaped like a plate extending, in a circular arc form, along the corner air discharge outlet (36). The stationary vane (39) is firmly fixed to the casing (10) and its outer peripheral edge is formed so as to extend substantially horizontally. As just described, by means of the stationary vane (39), the flow direction of air discharged from the corner air discharge outlet (36) is maintained in a substantially horizontal direction.

Operation of Indoor Unit

Next, how the air conditioning apparatus indoor unit (1) operates will be described.

When the fan motor (25) is driven to cause the fan (20) to rotate, indoor air is drawn in to the inside of the casing (10) through the air suction inlet (15) and through the air filter (17). The air drawn in to the inside of the casing (10) is guided to the center of the fan (20) by the bell-mouth (27) and is discharged outwardly relative to the radial direction of the fan (20). The air supplied from the fan (20) is cooled or heated by the heat exchanger (30), whereby conditioned air is generated. As shown in FIG. 2, the conditioned air is discharged in eight directions, respectively, from the line air discharge outlets (35) and the corner air discharge outlets (36) over the entire periphery of the casing (10). The opening are of the line air discharge outlet (35) is greater than the opening area of the corner air discharge outlet (36), in other words the volume of air supplied from the line air discharge outlet (35) is greater than the volume of air supplied from the corner air discharge outlet (36).

At the corner air discharge outlet (36), conditioned air is flow-adjusted by the stationary vane (39) and is discharged in a substantially horizontal direction. On the other hand, at the line air discharge outlet (35), the flow direction of conditioned air discharged therefrom is vertically adjusted by the swing vane (38).

To sum up, during cooling mode of operation, normally the motor (43) is driven to cause the leading end of each swing vane (38) to swing upwardly. Because of this, conditioned air is discharged in horizontal direction from the line air discharge outlet (35). On the other hand, when there is a strong demand for cooling of a room under space, the leading end of each swing vane (38) is swung downwardly by the driving of the motor (43) if required. At this time, conditioned air is discharged obliquely downwardly.

On the other hand, during heating mode of operation, the motor (43) is driven when the heating load is relatively great, such as when the operation is started, thereby to cause the leading end of each swing vane (38) to be swung downwardly. As the result of this, conditioned air is discharged obliquely downwardly through the line air discharge outlet (35) and the room under space is heated adequately. This heating operation is carried out continuously, and at the time when the heating load becomes relatively small the leading end of each swing vane (38) is made to swing upwardly so that the flow direction of air discharged from the line air discharge outlet (35) is maintained in a substantially horizontal direction, which prevents the conditioned air from being delivered directly to the user.

In the way as described above, a part of the conditioned air is discharged substantially horizontally through the corner air discharge outlet (36) and the remaining part of the conditioned air is discharged substantially horizontally or obliquely downwardly through the line air discharge outlet (35). As the result of this, room air conditioning operation is carried out adequately.

Effects of Embodiment 1

In accordance with the first embodiment, it is arranged such that conditioned air is discharged not only from the line air discharge outlet (35) but also from the corner air discharge outlet (36). Such arrangement makes it possible to increase the total opening area of the air discharge outlet (16). As a result, when supplying conditioned air at a predetermined flow rate into the room, it becomes possible to decrease user's draft feeling because the velocity of air at each air discharge outlet (35, 36) becomes relatively low.

Furthermore, at the corner air discharge outlet (36), air is discharged in a substantially horizontal direction by the stationary vane (39), in other words air is discharged to where the user is not present. This makes it possible to decrease drafts.

Additionally, also at the line air discharge outlet (35), it is possible to decrease drafts, as does the corner air discharge outlet (36), by causing the leading end of the swing vane (38) to swing upwardly so that air is discharged in a substantially horizontal direction.

Furthermore, air can be discharged downwardly by causing the leading end of the swing vane (38) to swing downwardly, whereby adequate air conditioning operation capable of providing a uniform temperature distribution in the room can be carried out.

In addition, the flow direction of air discharged from the air discharge outlet (16) is adjusted by such a simplified construction that the swing vane (38) extending in a straight line and the motor (43) are coupled together through the coupling pin (41) and the coupling shaft (42). This makes it possible to reduce the cost of providing means for air flow direction adjustment.

Embodiment 2

Figure 5:
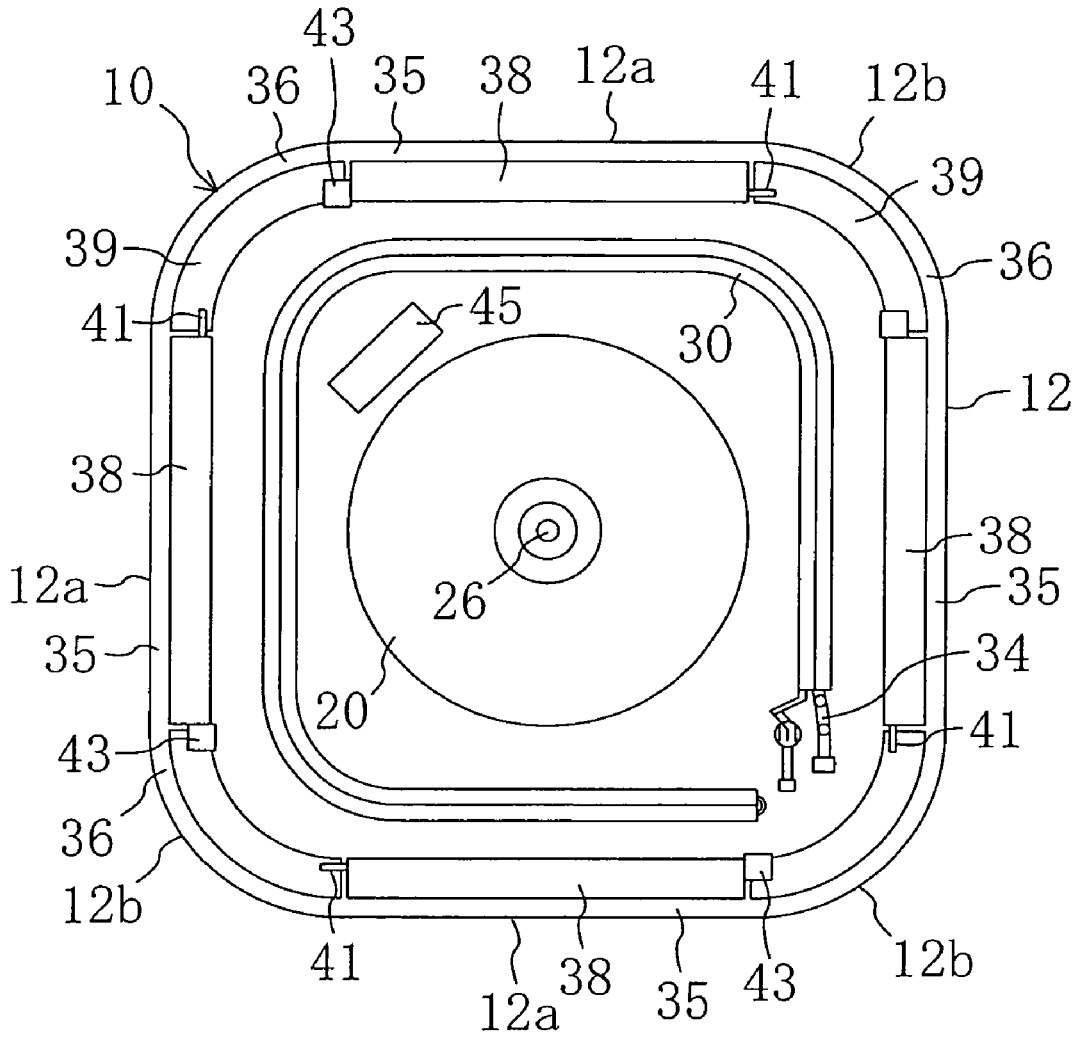
FIG. 5 is a front view schematically illustrating the interior of a casing of an indoor unit according to a second embodiment of the present invention.
Figure 6:
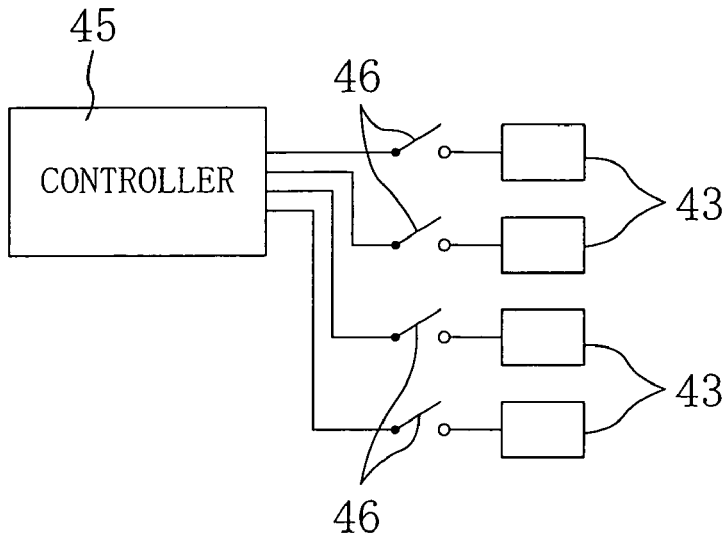
FIG. 6 is a wiring system diagram depicting a state of connection between a controller and each motor.
Figure 7:
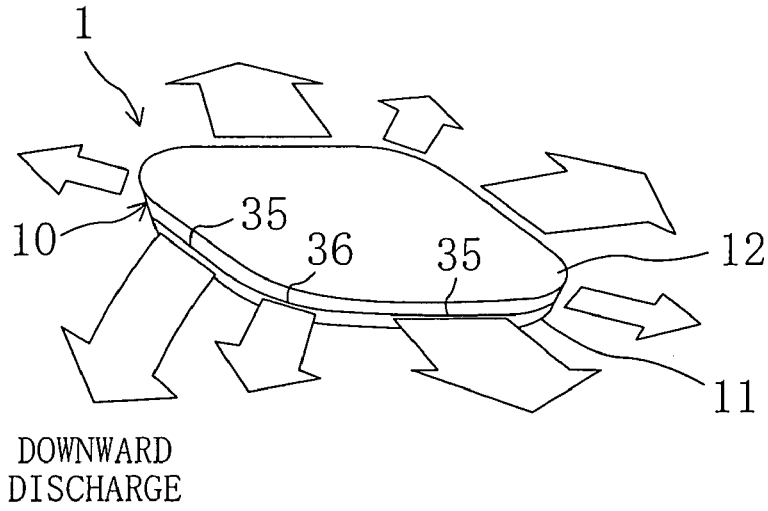
FIG. 7 is a schematic perspective view showing flow directions of air discharged from the indoor unit according to the second embodiment.

With reference to FIGS. 5–7, there is shown a second embodiment of the present invention. In each of the following embodiments, components which are similar to those described with reference to FIGS. 1–4 are assigned the same reference numerals, and the detailed description of each of these similar components is accordingly omitted here. In the second embodiment, the motors (43) for respectively driving the swing vanes (38) are coupled, respectively, to the coupling pins (41) serving as shafts of the swing vanes (38).

As shown in FIG. 5, one of the coupling pins (41) of each swing vane (38) is rotatably supported against the bottom plate (11) of the casing (10) and the other coupling pin (41) is coupled to the associated motor (43). Independent of the other swing vanes (38), each swing vane (38) is so configured as to swing up and down by the driving of its associated motor (43).

The top plate (12) of the casing (10) is provided with a controller (45) for controlling the driving of the motors (43). As shown in FIG. 6, a controller (45) is connected, via switches (46) each operable to establish connection and disconnection between its associated motor (43) and the controller (45), to the motors (43). And, electrical continuity between the controller (45) and the motor (43) is interrupted by the switch (46), thereby allowing the swing vane (38) to be manually swung up and down. In other words, each swing vane (38) is configured such that it can be held in a predetermined tilting position, independent of the other swing vanes (38).

Accordingly, in the second embodiment, in the case where the indoor unit (1) is installed near to a room wall or window, electrical continuity between the motor (43) of the swing vane (38) on the wall (window) side and the controller (45) is controlled by the controller (45) and is interrupted by the switch (46). Thereafter, the leading end of the swing vane (38) on the wall (window) side is manually swung down and is held in such a downwardly swung position.

In the way as just described above, as shown in FIG. 7, the flow direction of conditioned air discharged from the line air discharge outlet (35) on the wall (window) side is adjusted by the swing van (38) swung downwardly, whereby the conditioned air is discharged downwardly. Meanwhile, at each of the remaining line air discharge outlets (35), the swing vane (38) is caused to swing when controlled by the controller (45), and conditioned air is discharged up and down.

Effects of Second Embodiment

In accordance with the second embodiment, electrical continuity between the motor (43) connected to the swing vane (38) and the controller (45) is interrupted by means of the switch (46), thereby making it possible for the swing vane (38) to be swung down individually and thereafter to be held in such a downwardly swung position. Accordingly, even when the indoor unit (1) is installed in a ceiling area near to a wall or a window, a flow of air can be blown out downwardly from the line air discharge outlet (35) situated on the wall (window) side or near to the window by swinging the swing vane (38) downwardly and holding it in such a downwardly swung position. This prevents a flow of air from being delivered against the wall (window), thereby making it possible to inhibit the occurrence of a draft.

Furthermore, the perimeter of the room is air conditioned adequately by the air discharged downwardly from the line air discharge outlet (35).

Additionally, in the second embodiment, the switches (46) operable to interrupt electrical continuity between the controller (45) and each motor (43) are provided. Alternatively, there may be provided switches (not shown) capable of interrupting the drive current of the motors (43). More specifically, the supply of drive current to the motor (43) of the swing vane (38) is interrupted by the switch so that the swing vane (38) can manually be held in a predetermined tilting position, as in the second embodiment.

Embodiment 3

Figure 8:
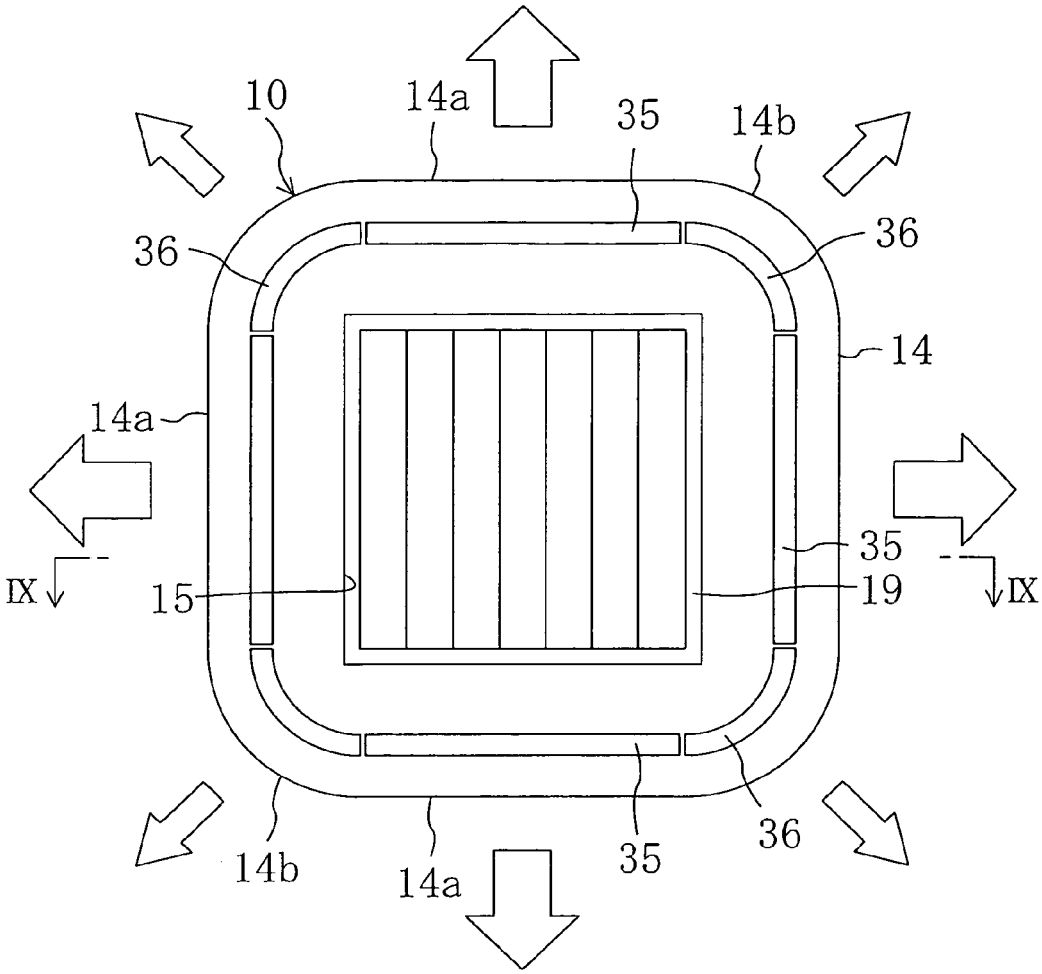
FIG. 8 is a front view illustrating an external outline of an indoor unit according to a third embodiment of the present invention.
Figure 9:
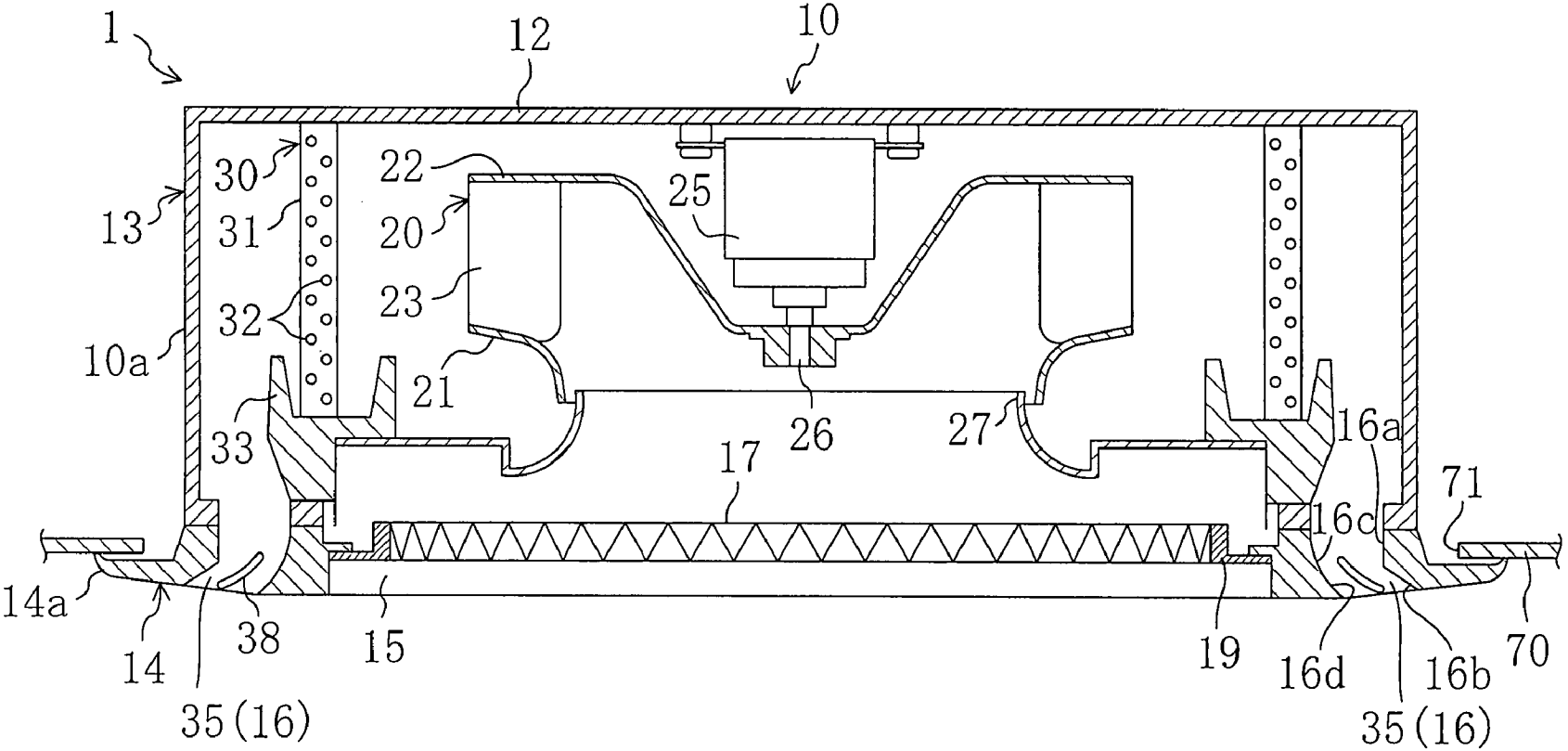
FIG. 9 is a cross sectional view taken along line IX—IX of FIG. 8.

With reference to FIGS. 8 and 9, there is shown a third embodiment of the present invention. The indoor unit (1) of the third embodiment is a ceiling mounted indoor unit adapted to embeddedly fit within an installation opening (71) defined in a ceiling plate (ceiling surface) (70). As shown in the figures, in the indoor unit (1), the casing (10) houses therein a fan (20) and a heat exchanger (30) which are similar to those described in each of the above-mentioned embodiments.

With reference to FIG. 8, the casing (10) is made up of a box-shaped main body casing (10*a*) which opens downwardly and a face panel (14) as a casing bottom for providing a covering over the bottom opening of the main body casing (10*a*). The main body casing (10*a*) comprises a top plate (12) and a side plate (13) extending downwardly from the outer edge of the top plate (12). The face panel (14) is formed from a substantially square plate member in which four side parts (14*a*, 14*a*, 14*a*, 14*a*) and four corner parts (14*b*, 14*b*, 14*b*, 14*b*) are formed in contiguous relationship to one another. The face panel (14) is attached to the lower end of the side plate (13) of the main body casing (10*a*) and is mounted along the ceiling plate (70) so that its peripheral edge is in abutment with a lower surface of the top plate (70).

As shown in FIG. 9, an air suction inlet (15) shaped like a square is opened substantially in the center of the face panel (14). An air filter (17) is mounted over the air suction inlet (15), and the air filter (17) is supported by a filter cover (19).

Formed around the air suction inlet (15) of the face panel (14) is an air discharge outlet (16). The air discharge outlet (16) is made up of line and corner air discharge outlets (35) and (36), as in each of the foregoing embodiments.

The line air discharge outlets (35) are formed into an elongated rectangular shape so as to extend, respectively, along four side parts (14*a*, 14*a*, 14*a*, 14*a*) of the face panel (14). On the other hand, the corner air discharge outlets (36) are formed, respectively, along four corner parts (14*b*, 14*b*, 14*b*, 14*b*), into a circular arc shape. The line and corner air discharge outlets (35) and (36) are formed such that in the lower surface of the face panel (14) they are substantially in contiguous relationship to one another relative to the circumferential direction of the face panel (14).

The line and corner air discharge outlets (35) and (36) are made up of an outer guide surface (16*a*, 16*b*) which is an outer peripheral side wall of the face panel (14) and an inner guide surface (16*c*, 16*d*) which is an inner peripheral side wall of the face panel (14). The outer guide surface (16*a*, 16*b*) is made up of a first outer guide surface (16*a*) extending substantially vertically downwardly and a second outer guide surface (16*b*) sloping obliquely downwardly towards the panel outer peripheral side from the lower end of the first outer guide surface (16*a*) to the lower surface of the face panel (14). On the other hand, the inner guide surface (16*c*, 16*d*) is made up of a first inner guide surface (16*c*) extending substantially vertically downwardly and a second inner guide surface (16*d*) sloping gently obliquely downwardly from the lower end of the first inner guide surface (16*c*) towards the panel outer peripheral side.

Like each of the foregoing embodiments, the line air discharge outlet (35) is provided with a swing vane (38). On the other hand, the corner air discharge outlet (36) is provided with a stationary vane (not shown). The swing vane (38) and the stationary vane are each curved slightly over the width direction thereof. The swing vane (38) is disposed along the line air discharge outlet (35) and is rotatably supported against the face panel (14). Although not shown diagrammatically, each swing vane (38) is connected, via a coupling pin and a coupling shaft, to the motor, as in the first embodiment. On the other hand, the stationary vane is disposed along the corner air discharge outlet (36) and is firmly affixed to the face panel (14), and its leading end extends in a horizontal direction.

Therefore, also in the third embodiment, air drawn in through the air suction inlet (15) when the fan (20) is driven is cooled or heated in the heat exchanger (30), flows through an air passageway on the outer peripheral side of the casing (10) and is discharged into the room from the line and corner air discharge outlets (35) and (36), as in the first embodiment. Air is blown out to an upper space of the room from the corner air discharge outlet (36) by the stationary vane (39). On the other hand, the flow direction of air discharged from the line air discharge outlet (35) is adjusted vertically by causing the swing vane (38) to swing.

As has been described above, also in the third embodiment, the same effects as those accomplished in the first embodiment are obtained. In addition to this, the main body casing (10*a*) of the casing (10) is embedded in the ceiling surface (70), thereby providing space savings, and the room space is utilized effectively.

Other Embodiments

In each of the foregoing embodiments, the guide means is formed by the stationary vane (39). The guide means, however, is not limited to the stationary vane (39).

In other words, the guide means may be formed by a movable vane which is manually rotatable. It may be arranged such that the movable vane is attached to the casing (10) with a pin and the tilt of the movable vane is changed, thereby to change the flow direction in which conditioned air is discharged.

To sum up, the aforesaid guide means may be of any type as long as it is able to allow conditioned air to be blown out in a fixed direction.

INDUSTRIAL APPLICABILITY

As described above, the present invention provides an indoor unit for an air conditioning apparatus which is useful for the cases where conditioned air is discharged into the room from the entire periphery thereof.

What is claimed is:

1. An indoor unit for an air conditioning apparatus, adapted for room-ceiling mounting, which is provided with an air discharge outlet (16) for discharge of conditioned air therefrom, wherein said air discharge outlet (16) comprises:

line air discharge outlets (35) extending, respectively, along four sides of a casing bottom part (11) having four side parts (11*a*) and four corner parts (11*b*) wherein said parts (11*a*, 11*b*) are formed in contiguous relationship to one another, and corner air discharge outlets (36) formed, respectively, in said four corner parts (11*b*), each said corner air discharge outlet (36) establishing connection between adjacent ones of said line air discharge outlets (35), wherein each said line air discharge outlet (35) is provided with a swing vane (38) swingable about a longitudinal axis of each said line air discharge outlet (35), and wherein each said corner air discharge outlet (36) is provided with guide means (39) by means of which conditioned air is discharged in a fixed direction.

2. The air conditioning apparatus indoor unit of claim 1, wherein said guide means (39) is a fixed stationary vane (39).

3. The air conditioning apparatus indoor unit of claim 1, wherein each said swing vane (38) is so configured as to be individually able to be held in a predetermined tilting position.

4. The air conditioning apparatus indoor unit of claim 3, wherein motors (43) for respectively driving said swing vanes (38) are connected, respectively, to shafts (41) of said swing vanes (38), and wherein a controller (45) for controlling the driving of said motors (43) is connected, via switches (46) each operable to establish connection and disconnection between its associated motor (43) and said controller (45), to said motors (43).

5. The air conditioning apparatus indoor unit of claim 3 further including motors (43), connected, respectively, to shafts (41) of said swing vanes (38), for respectively driving said swing vanes (38), and switches each operable to interrupt the drive current of its associated motor (43).

* * * * *

UNITED STATES PATENT AND TRADEMARK OFFICE

CERTIFICATE OF CORRECTION

PATENT NO. : 7,204,096 B2
APPLICATION NO. : 10/533200
DATED : April 17, 2007
INVENTOR(S) : Toru Iwata et al.

It is certified that error appears in the above-identified patent and that said Letters Patent is hereby corrected as shown below:

Line item (54)
"(54) INDOOR APPARATUS FOR AIR CONDITIONER"

Should read:

--(54) INDOOR UNIT FOR AIR CONDITIONING APPARATUS--

Signed and Sealed this

Third Day of July, 2007

JON W. DUDAS
*Director of the United States Patent and Trademark Office*